US011460262B2

(12) United States Patent
Underwood et al.

(10) Patent No.: US 11,460,262 B2
(45) Date of Patent: Oct. 4, 2022

(54) MALFUNCTION SIMULATION INSERT

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 161 days.

(21) Appl. No.: 16/924,440

(22) Filed: Jul. 9, 2020

(65) Prior Publication Data

US 2021/0010776 A1 Jan. 14, 2021

Related U.S. Application Data

(60) Provisional application No. 62/872,587, filed on Jul. 10, 2019.

(51) Int. Cl.
*F41A 33/00* (2006.01)

(52) U.S. Cl.
CPC ..... *F41A 33/00* (2013.01)

(58) Field of Classification Search
CPC ..... F41A 9/66
USPC ..... 42/90, 87, 106
See application file for complete search history.

(56) References Cited

U.S. PATENT DOCUMENTS

| | | | | |
|---|---|---|---|---|
| 9,423,221 | B2 * | 8/2016 | Bonner | F42B 8/08 |
| 11,002,523 | B2 * | 5/2021 | Billings | F41A 33/00 |
| 2016/0245610 | A1 * | 8/2016 | Schulz | F41A 9/65 |
| 2017/0363398 | A1 * | 12/2017 | McCloy | F42B 8/08 |
| 2018/0195843 | A1 * | 7/2018 | Gerfin | F42B 8/08 |

* cited by examiner

*Primary Examiner* — Reginald S Tillman, Jr.

(57) ABSTRACT

A malfunction insert is for a firearm that includes a magazine. The malfunction insert includes a narrow end comprising a narrow edge, a concave surface disposed at an opposite end of the malfunction insert from the narrow end, and a central member that connects the concave surface and the narrow end. The malfunction insert is configured to be inserted into the magazine.

22 Claims, 4 Drawing Sheets

MALFUNCTION SIMULATION INSERT

CROSS REFERENCE TO RELATED APPLICATION

This application is related to and claims priority benefit from U.S. Provisional Application No. 62/872,587 ("the '587 application"), filed on Jul. 10, 2019 and entitled "MALFUNCTION SIMULATION INSERT." The '587 application is hereby incorporated in its entirety by this reference.

FIELD OF THE INVENTION

The field of the invention relates to firearms, particularly methods and devices for simulating malfunctions for a firearm.

BACKGROUND

Many modern firearms (including handguns, rifles, carbines, shotguns, etc.) include a magazine for storing and/or feeding ammunition. Magazines may be integral/fixed to the firearm or may be detachable. Different magazine arrangements include tube, box, rotary, drum, casket, pan, helical, saddle-drum, or various other arrangements.

Due to industry standardization, improved manufacturing techniques, improved manufacturing tolerances, material properties, and other various factors, modern firearms are very reliable and often fire thousands or tens of thousands of rounds without a malfunction (even with minimal cleaning). However, malfunctions may still occur. Military, law enforcement, or other organizations may want to train firearm operators to react and address firearm malfunctions. Accordingly, it may be desirable to include a conspicuous or inconspicuous device within a magazine of a firearm to intentionally cause a malfunction to aid in training.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a malfunction insert for a firearm that comprises a magazine, the malfunction insert comprises: a body comprising a concave surface and a narrow end extending to an opposite side of the body from the concave surface, wherein: the body is configured to be inserted into the magazine; and in use, the narrow end is configured to engage a feed lip of the magazine while the concave surface engages an upper surface of a cartridge.

According to certain embodiments of the present invention, a malfunction insert for a firearm that comprises a magazine, the malfunction insert comprises: a narrow end comprising a narrow edge; a concave surface disposed at an opposite end of the malfunction insert from the narrow end; a central member that connects the concave surface and the narrow end, wherein: the malfunction insert is configured to be inserted into the magazine.

According to certain embodiments of the present invention, a method of creating a malfunction in a firearm that includes a magazine, the method comprises: inserting at least one initial cartridge into the magazine of the firearm to push a magazine follower downward; inserting a malfunction insert into the magazine, wherein the malfunction insert comprises a body with a concave surface and a narrow end extending to an opposite side of the body from the concave surface; and inserting a plurality of later cartridges into the magazine after the malfunction insert.

DETAILED DESCRIPTION

Figure 1:
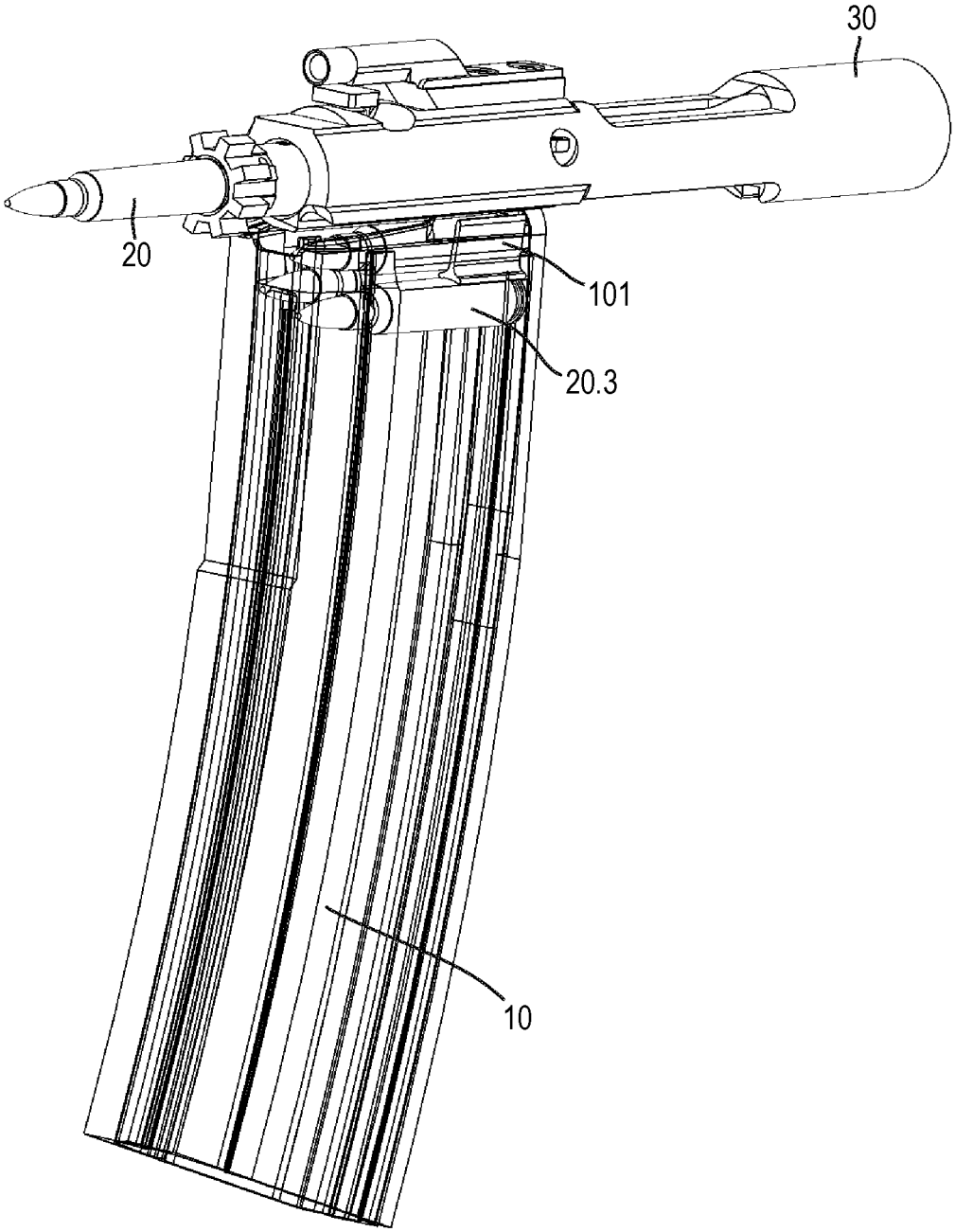
FIG. 1 is a perspective view of a malfunction insert inside a magazine according to certain embodiments of the present invention.
Figure 2A:
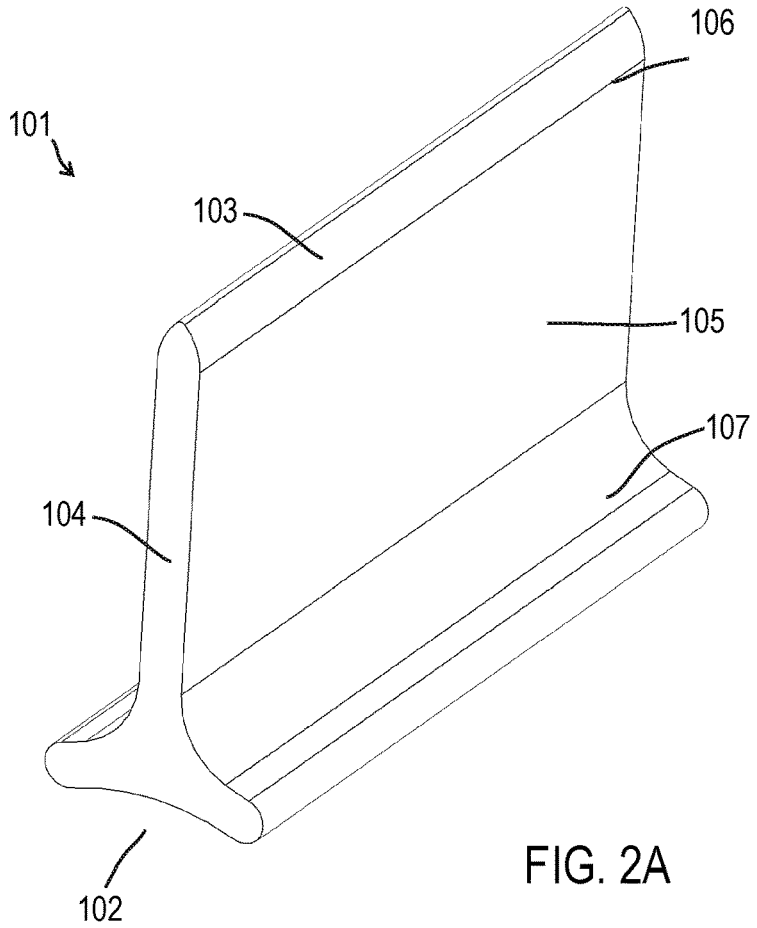
FIG. 2A is a top perspective view of the malfunction insert of FIG. 1.
Figure 2B:
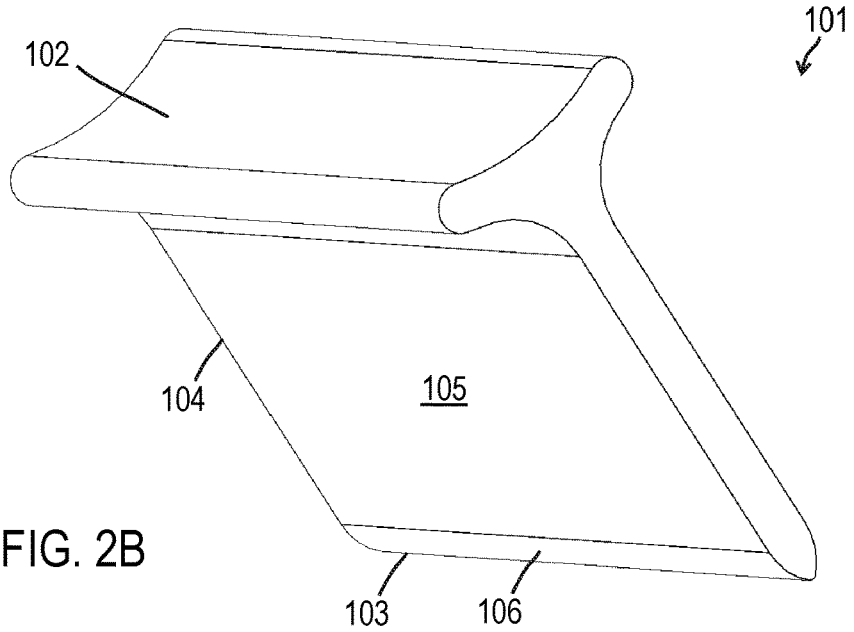
FIG. 2B is a bottom perspective view of the malfunction insert of FIG. 1.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-4 illustrate components of various semi-automatic or automatic rifles, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, 0.223 Remington, 7.62×51 mm NATO, 0.308 Winchester, 7.62×39 mm, 5.45×39 mm; handgun calibers such as, for example, 9×19 mm, 0.45 ACP, 0.40 S&W, 0.380 ACP, 10 mm Auto, 5.7×28 mm; and shotgun calibers such as, for example, 12 gauge, 20 gauge, 28 gauge, 0.410 gauge, 10 gauge, 16 gauge.

According to certain embodiments of the present invention, as shown in FIGS. 1-4, a malfunction insert 101 may be located within a magazine 10 of a firearm with cartridges 20 (e.g., cartridges 20.1-20.3). The magazine 10 is shown transparent in FIGS. 1 and 4 for illustrative purposes. In addition, the cartridges 20.1-20.3 and the malfunction insert 101, which are typically disposed inside the magazine 10 are shown without the magazine 10 present in FIG. 3. The malfunction insert 101 may include a body with a concave surface 102 and a narrow end 103 (see FIGS. 2A-2B). In some embodiments, the concave surface 102 and the narrow end 103 are connected by a central member 104. The central member 104 may include at least one outer face 105. In some cases, each outer face 105 is planar, while in other embodiments, each outer face 105 has a non-planar profile. The body of the malfunction insert 101 may have a "T" or "Y" cross-sectional shape. The narrow end 103 may narrow from the profile of the central member 104 down to a narrow edge. In some embodiments, the narrow end 103 includes at least one surface 106 that tapers linearly toward the narrow edge. Alternatively, as shown in FIGS. 2A and 2B, the narrow end 103 may include surface(s) 106 that curve (in a non-linear manner) toward the narrow edge. At the transition between the central member 104 and the concave surface 102, the malfunction insert 101 may include at least one transition surface 107. The transition surface 107 may be a curved surface between the central member 104 and the concave surface 102. In some embodiments, the shape of the concave surface 102 is designed to approximately match the outer shape of a cartridge 20 for the firearm.

In some embodiments, one or more malfunction insert(s) 101 may be inserted into a magazine 10 to create intentional, predictable, and expected malfunction(s). Some magazines 10 are designed for a double stack configuration where two columns of cartridges are arranged side-by-side in the magazine. As one example, the configuration shown for magazine 10 in FIGS. 3 and 4 includes two columns where cartridges 20.1 and 20.3 are in one column (i.e., the left side column when looking from the rear of the firearm toward the front) and cartridge 20.2 is in a different column (i.e., the right side column when looking from the rear of the firearm toward the front). The body of magazine 10 is shown as transparent in FIGS. 1 and 4. In addition, other components of the magazine, such as the follower and spring attached to the underside of the follower, are not shown in any of the drawings for illustrative purposes.

For typical firearm operation (when a malfunction insert 101 is not present), a bolt carrier group 30 moves rearward due to manual operation/movement (e.g., operating a charging handle and/or bolt release) or may be caused by cycling of the firearm after firing a projectile. Subsequently, the bolt carrier group 30 moves forward and passes over the top of the magazine 10 such that the leading edge 31 of the bolt carrier group 30 pushes the uppermost cartridge (e.g., cartridge 20.1) out of the magazine and toward the chamber of the firearm (not shown). In other words, under normal operation, if the malfunction insert 101 were not present for the configuration shown in FIGS. 3 and 4, the bolt carrier group 30 would move rearward such that the leading edge 31 moves past the magazine and the three cartridges 20.1-20.3 would remain inside the magazine due to the internal geometry of the magazine 10 (including the feed lips 11 and the follower, which is not shown) and the stacking alternating arrangement of the cartridges 20. When the leading edge 31 moves forward over the top of the magazine 10, the leading edge 31 would engage the rear end of one cartridge (cartridge 20.1) and push this cartridge out of the magazine and toward the chamber of the firearm.

Figure 3:
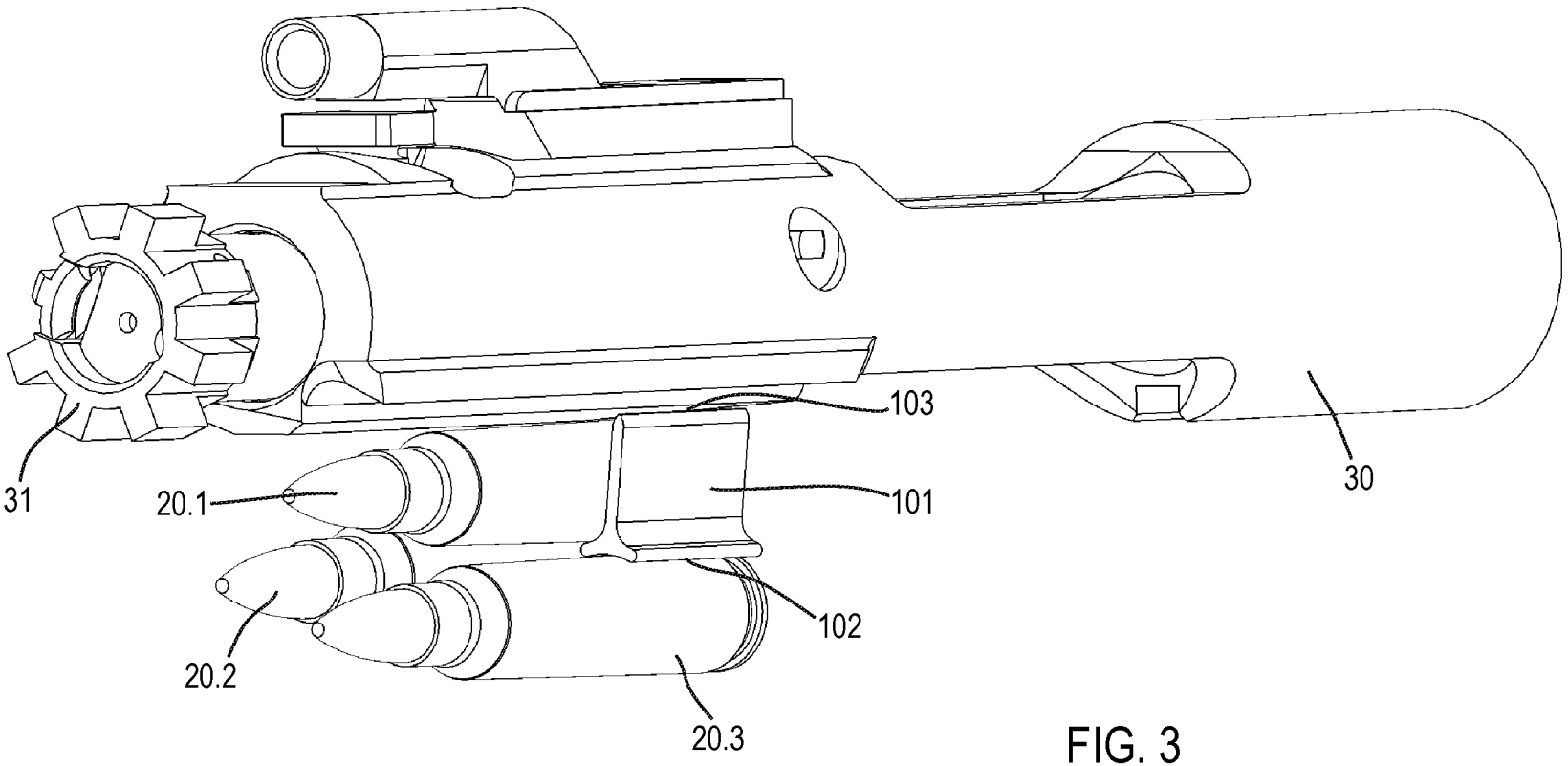
FIG. 3 is a perspective view of the malfunction insert of FIG. 1.
Figure 4:
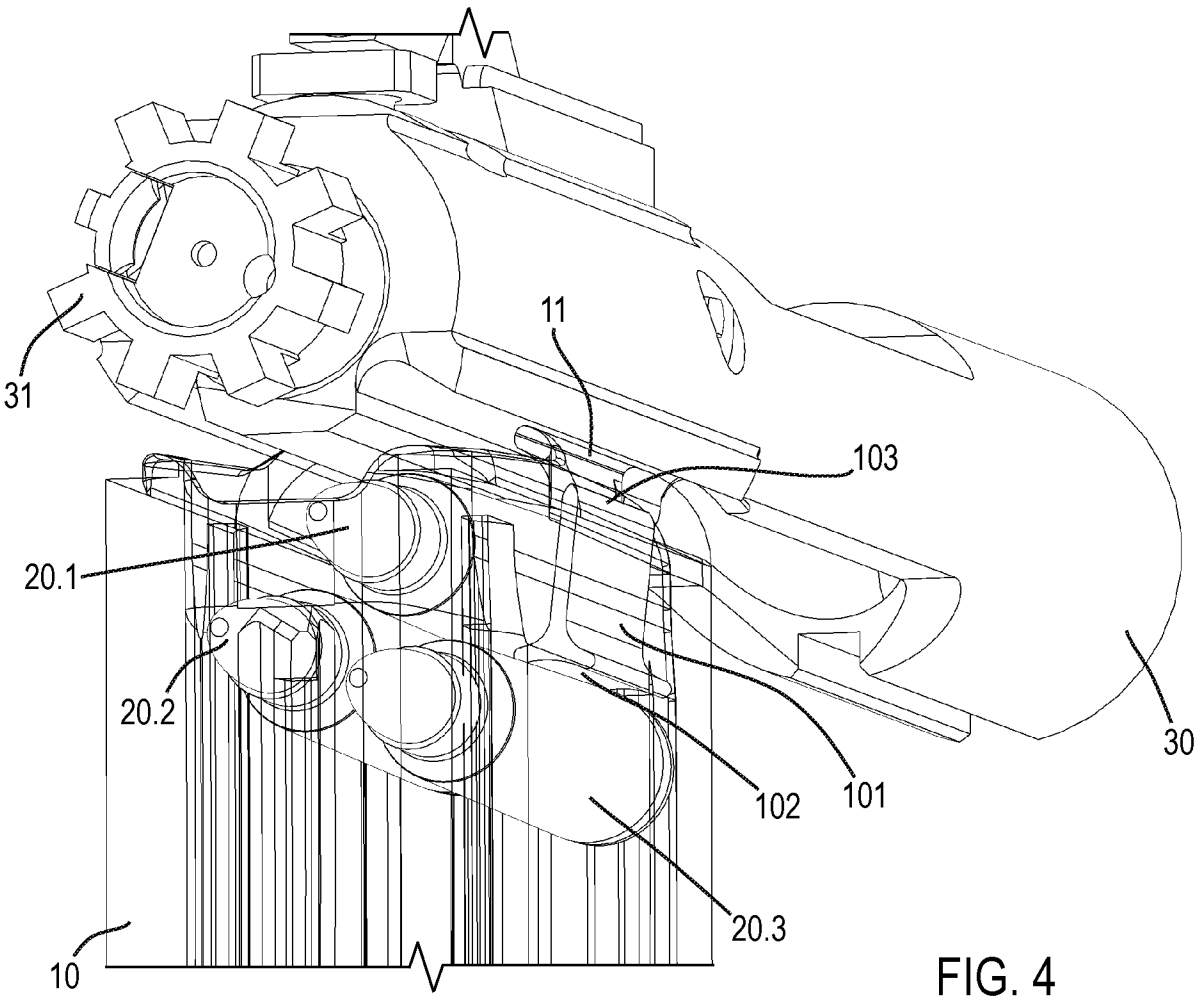
FIG. 4 is a perspective view of the malfunction insert of FIG. 1.

The malfunction insert 101 may be inserted into the magazine 10 when cartridges 20 are loaded into the magazine (i.e., when cartridges 20 are loaded into the top of the magazine 10 pushing the follower down and compressing the magazine spring). Although the malfunction insert 101 is shown interfacing with cartridge 20.3 in the left side column, the malfunction insert 101 can be inserted into the right side column also. As shown in FIGS. 3 and 4, the malfunction insert 101 is arranged such that the concave surface 102 is disposed adjacent to an upper side of a cartridge 20 and the narrow end 103 extends upward. Additional cartridges 20 can be loaded into the magazine 10 after inserting the malfunction insert 101. For example, additional cartridges 20 can be inserted into the top of magazine 10 such that cartridges 20.1-20.3 would move downward toward a bottom of the magazine 10 (see FIG. 4). The malfunction insert 101 does not affect the operation of the firearm for cartridges above the affected cartridges 20 in the magazine 10, and the malfunction insert 101 does not affect any firearm operation until the narrow end 103 engages the feed lip 11 of the magazine 10. In other words, cartridges 20 loaded after cartridge 20.1 would cycle and operate normally.

FIGS. 3 and 4 show a configuration where the malfunction insert 101 is arranged to create a malfunction in the firearm. The bolt carrier group 30 is shown in an intermediate position between the forward position (where the leading edge 31 of the bolt carrier group 30 is adjacent to the chamber) and the rear position (where the leading edge 31 of the bolt carrier group 30 is aft of the magazine 10). In the configuration shown in FIGS. 3 and 4, the malfunction insert 101 engages the feed lip 11 of the magazine 10 and prevents cartridge 20.3 from moving upward. The downward pressure on cartridge 20.3 (and the resultant lower position within the magazine of cartridge 20.3) affect the stacking alternating arrangement of the cartridges 20 such that cartridge 20.1 is not constrained by the adjacent cartridges and the internal geometry of the magazine 10. In other words, for the configuration shown in FIGS. 3 and 4, cartridge 20.1 is only stowed within magazine 10 because it bears against the underside of the bolt carrier group 30. As a result, when the bolt carrier group 30 moves rearward past the magazine 10, cartridge 20.1 immediately exits the top of the magazine 10 due to pressure from the follower and magazine spring and enters the space within the upper receiver (not shown) vacated by the bolt carrier group 30. After cartridge 20.1 exits the magazine 10, cartridges 20.2 and 20.3 immediately move to the two uppermost positions within the magazine, and the magazine resumes normal operation such that cartridge 20.2 is retained within the magazine 10 at the uppermost position of the magazine. The subsequent forward movement of the bolt carrier group 30 causes the leading edge 31 to engage the rear end of cartridge 20.2 and push this cartridge out of the magazine and toward the chamber of the firearm leaving cartridge 20.3 in the uppermost position within magazine 10. Accordingly, as a result of the configuration shown in FIGS. 3 and 4, after cycling the bolt carrier group 30 rearward and forward again, the firearm has both cartridge 20.1 and cartridge 20.2 within the upper receiver moving toward the chamber. This creates a firearm malfunction known as a "double feed."

In some embodiments, the malfunction insert 101 exits the magazine 10 concurrent with or after cartridges 20.1 and 20.2 exit the magazine 10. The malfunction (i.e., the double feed) will cause the firearm to malfunction because both cartridges 20.1 and 20.2 will simultaneously try to enter the chamber of the firearm which prevents the bolt carrier group 30 from moving to the forward position (i.e., the firearm will be out-of-battery because the bolt does not move to the forward or firing position). To address the malfunction, the firearm operator will move the bolt carrier group 30 to the rear or open position (and, in some cases, lock the bolt carrier group 30 in the open position). In some cases, the operator may also remove the magazine 10 from the firearm, if applicable. After cartridges 20.1 and 20.2 along with malfunction insert 101 are removed from the firearm, the firearm will operate normally. For example, subsequent movement of the bolt carrier group 30 will cause the leading edge 31 of the bolt carrier group 30 to push the uppermost cartridge (e.g., cartridge 20.3) out of the magazine and toward the chamber of the firearm. As described in more detail below, the malfunction insert 101 may be made from a non-metallic material to reduce the likelihood of damage to the interior of the magazine 10 or the firearm. The malfunction insert 101 may exit the magazine and enter the upper receiver of the firearm. In some embodiments, the malfunction insert 101 is constructed from brightly colored or high visibility material to ensure that the malfunction insert 101 is conspicuous after exiting the magazine (either into the upper receiver or outside of the firearm). The malfunction insert 101 may be orange or another high visibility color/pattern.

The components of any of the firearms described herein, including the malfunction insert 101, may be formed of materials including, but not limited to, thermoplastic, carbon composite, plastic, nylon, steel, aluminum, stainless steel, high strength aluminum alloy, other plastic or polymer materials, other metallic materials, other composite materials, or other similar materials. In particular, the malfunction insert 101 may be made from Polyamides (PA), Polycarbonate (PC), Polyester (PES), Polyethylene (PE), High-density polyethylene (HDPE), Low-density polyethylene (LDPE), Polyethylene terephthalate (PET), Polypropylene (PP), Polystyrene (PS), High impact polystyrene (HIPS), Polyurethanes (PU), Polyvinyl chloride (PVC), Polyvinylidene chloride (PVDC), Acrylonitrile butadiene styrene (ABS), or any other appropriate non-metallic material. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A malfunction insert for a firearm that comprises a double stack magazine, the malfunction insert comprising:
- a body comprising a concave surface and a narrow end extending to an opposite side of the body from the concave surface, wherein:
- the body is configured to be inserted into the double stack magazine;
- when inserted into the double stack magazine, the body: contacts a first cartridge located in a first column in the double stack magazine; extends upward beyond a second cartridge located in a second column in the double stack magazine; and extends laterally adjacent to a third cartridge in the first column in the double stack magazine; and
- in use, the narrow end is configured to engage a feed lip of the double stack magazine while the concave surface engages an upper surface of the first cartridge.

2. The malfunction insert of claim 1, wherein the concave surface and the narrow end are connected by a central member.

3. The malfunction insert of claim 2, wherein the central member comprises at least one planar face.

4. The malfunction insert of claim 1, wherein the concave surface comprises a contoured shape corresponding to an outer surface of the first cartridge.

5. The malfunction insert of claim 1, wherein the malfunction insert is configured to cause a double feed where two cartridges exit the double stack magazine during a single firearm cycle.

6. The malfunction insert of claim 1, wherein the body comprises a "T" shape.

7. The malfunction insert of claim 1, wherein the body comprises a non-metallic material.

8. A malfunction insert for a firearm that comprises a double stack magazine designed to hold a plurality of cartridges, the malfunction insert comprising:
- a narrow end comprising a narrow edge;
- a concave surface disposed at an opposite end of the malfunction insert from the narrow end;
- a central member that connects the concave surface and the narrow end, wherein:
- a length of the narrow edge corresponds to an overall length and largest dimension of the malfunction insert;
- the overall length of the malfunction insert is less than half of a length of one of the plurality of cartridges; and
- the malfunction insert is configured to be inserted into between the plurality of cartridges in the double stack magazine.

9. The malfunction insert of claim 8, wherein the malfunction insert is configured to engage a portion of the double stack magazine.

10. The malfunction insert of claim 8, wherein the narrow end comprises at least one surface that curves toward the narrow edge.

11. The malfunction insert of claim 8, wherein the central member comprises at least one planar face.

12. The malfunction insert of claim 8, wherein the concave surface comprises a contoured shape corresponding to an outer surface of one of the plurality of cartridges.

13. The malfunction insert of claim 8, wherein the malfunction insert is configured to cause a double feed where two cartridges exit the double stack magazine during a single firearm cycle.

14. The malfunction insert of claim 8, wherein a cross section of the malfunction insert comprises a "T" shape.

15. The malfunction insert of claim 8, wherein the malfunction insert comprises a non-metallic material.

16. A method of creating a malfunction in a firearm that includes a double stack magazine, the method comprising:
- inserting at least one initial cartridge into the double stack magazine of the firearm to push a magazine follower downward;
- inserting a malfunction insert into the double stack magazine, wherein the malfunction insert comprises a body with a concave surface and a narrow end extending to an opposite side of the body from the concave surface; and
- inserting a plurality of later cartridges into the double stack magazine after the malfunction insert,
- wherein the body: contacts the at least one initial cartridge in a first column in the double stack magazine; extends upward beyond a second cartridge located in a second column in the double stack magazine; and extends laterally adjacent to a third cartridge in the first column in the double stack magazine.

17. The method of claim 16, further comprising arranging the malfunction insert such that the concave surface engages an outer upper surface of the at least one initial cartridge.

18. The method of claim 16, further comprising arranging the malfunction insert such that the narrow end is aligned with a feed lip of the double stack magazine.

19. The method of claim 16, further comprising removing at least one of the plurality of later cartridges engaging an underside of a feed lip of the double stack magazine with the narrow end to create a double feed malfunction.

20. The method of claim 16, further comprising inserting a second malfunction insert after the plurality of later cartridges.

21. A malfunction insert for a firearm that comprises a magazine, the malfunction insert comprising:

a body comprising a concave surface and a narrow end extending to an opposite side of the body from the concave surface, wherein:

the body is configured to be inserted into the magazine;

in use, the narrow end is configured to engage a feed lip of the magazine while the concave surface engages an upper surface of a cartridge; and the body comprises a "T" shape.

22. The malfunction insert of claim 1, wherein an overall length of the malfunction insert is less than half of a length of one of the cartridges.

* * * * *